United States Patent [19]

Crawford et al.

[11] 4,003,323

[45] Jan. 18, 1977

[54] APPARATUS FOR MANUFACTURING AND STACKING HEMMED FABRIC PIECES

[75] Inventors: Douglas J. Crawford, Troy; Roger LeMere, Petersberg; Francis H. Hughes, Troy, all of N.Y.

[73] Assignee: Cluett, Peabody & Co., Inc., New York, N.Y.

[22] Filed: Apr. 23, 1975

[21] Appl. No.: 570,808

Related U.S. Application Data

[62] Division of Ser. No. 344,227, March 23, 1973, Pat. No. 3,898,941.

[52] U.S. Cl. ..... 112/141; 112/147

[51] Int. Cl.[2] ..... D05B 35/02

[58] Field of Search ..... 112/141, 142, 147, 121.27, 112/121.26, 2

[56] References Cited

UNITED STATES PATENTS

| | | | |
|---|---|---|---|
| 1,376,623 | 5/1921 | Hughes, Jr. | 112/147 X |
| 1,741,866 | 12/1929 | Mann | 112/147 |
| 3,525,310 | 8/1970 | Gensheimer | 112/142 |
| 3,534,954 | 10/1970 | Lynch, Jr. | 112/147 X |
| 3,898,941 | 8/1975 | Crawford et al. | 112/147 X |
| 3,906,877 | 9/1975 | Rockerath et al. | 112/141 |

*Primary Examiner*—Werner H. Schroeder
*Assistant Examiner*—Peter Nerbun

[57] ABSTRACT

This disclosure teaches an apparatus for manufacturing and stacking hemmed fabric pieces (usually pockets) with the hems either lined or unlined. In the case of lined hemmed fabric pieces, pieces of a liner tape are fed in cut lengths in turn along a path. Limp fabric pieces (the pockets) are inserted manually by an operator and are positioned automatically each on one of the liner pieces. A hem is formed out of a margin of the fabric piece around its related liner piece and a terminal margin flap is tucked under itself. The hem is sewn along the terminal flap. The hemmed lined fabric pieces are then inserted in turn into a cartridge upwardly and the cartridge is revolved about a vertical axis as successive of the hemmed lined fabric pieces are inserted therein so that uneven height caused by the hems is distributed about the stack. In the case of unlined fabric pieces, the apparatus functions substantially the same in positioning the limp fabric pieces, hemming and stacking.

2 Claims, 31 Drawing Figures

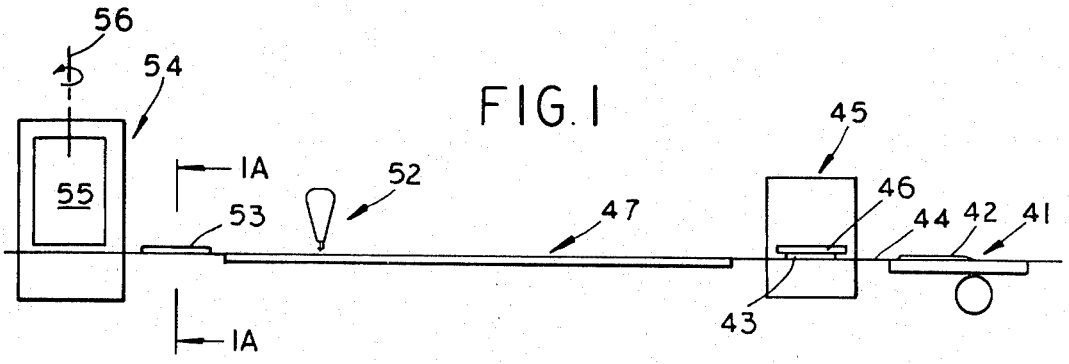
FIG. 1
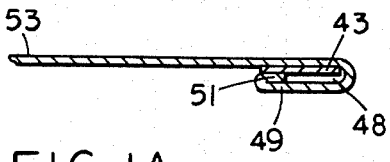
FIG. 1A
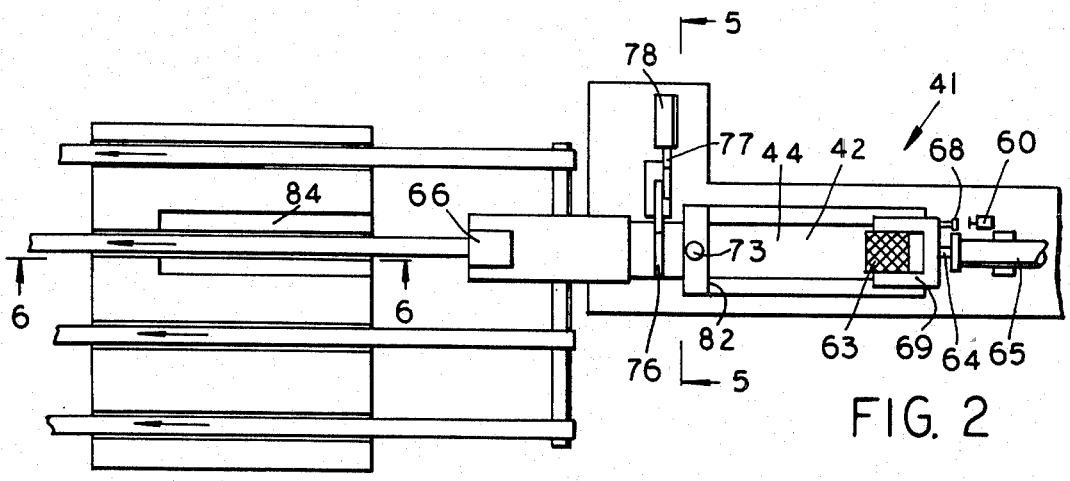
FIG. 2
FIG. 3
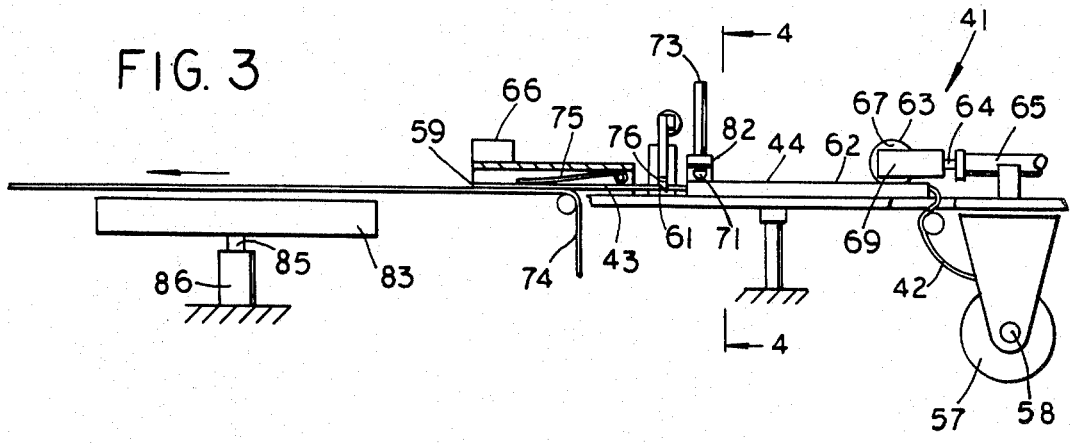

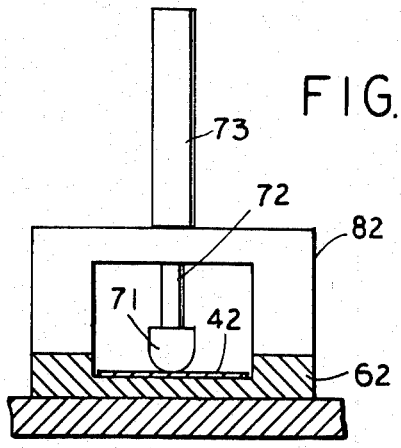
FIG. 4
FIG. 5
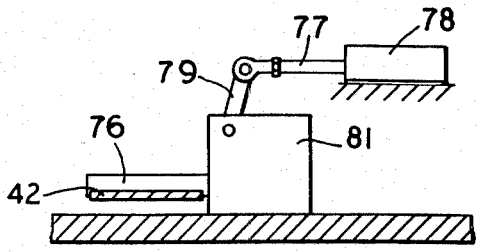
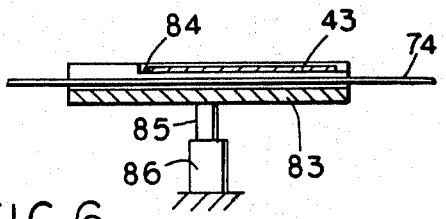
FIG. 6
FIG. 7
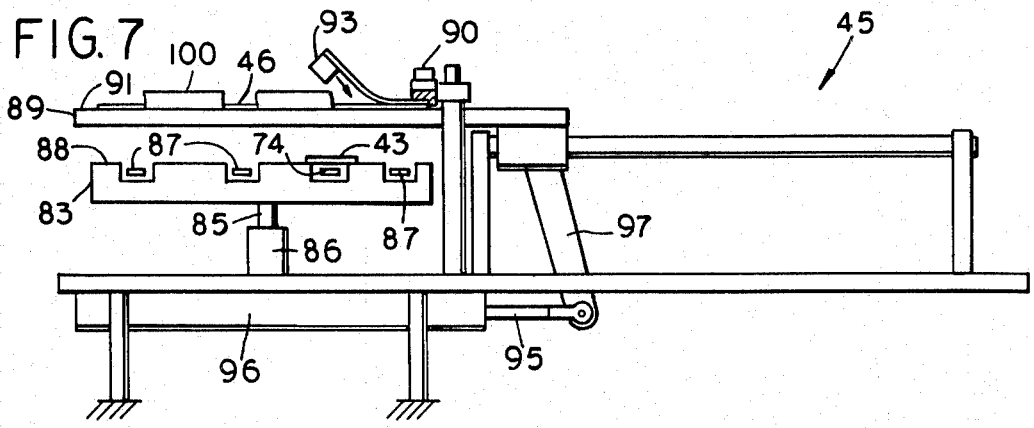
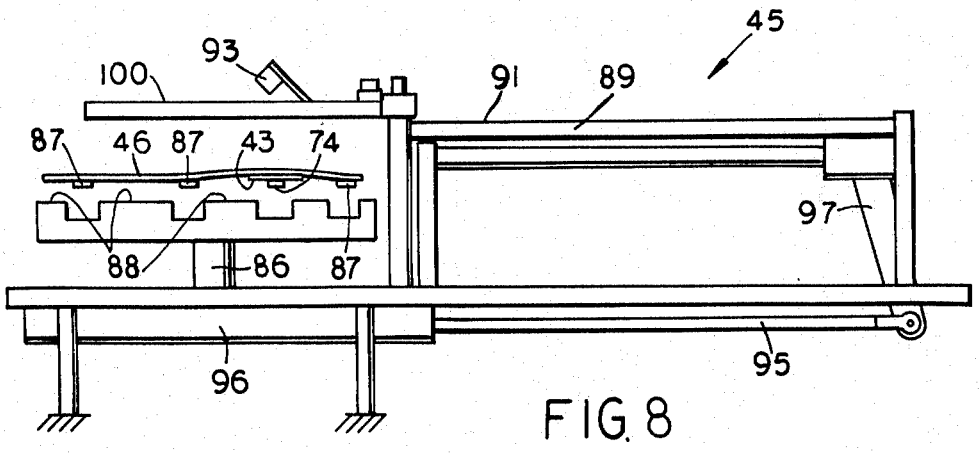
FIG. 8

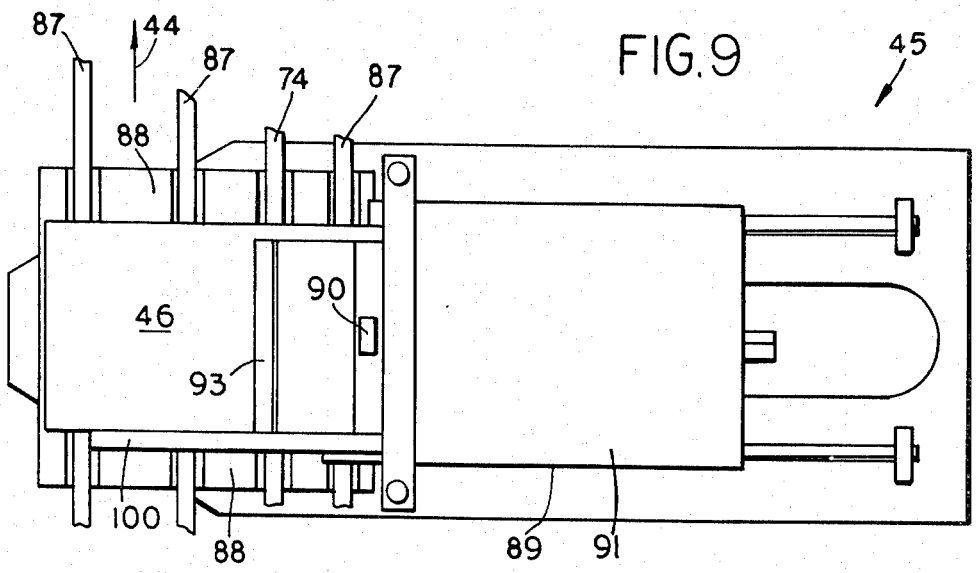
FIG. 9
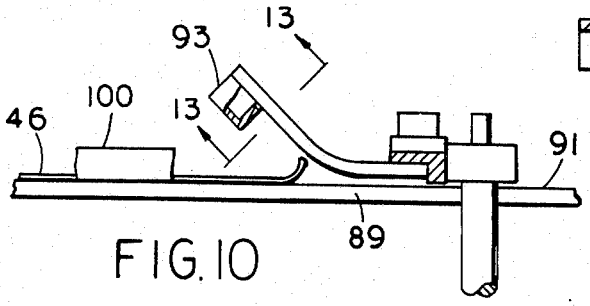
FIG. 10
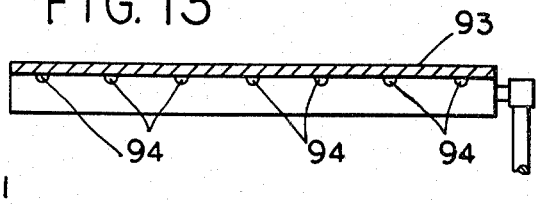
FIG. 13
FIG. 14
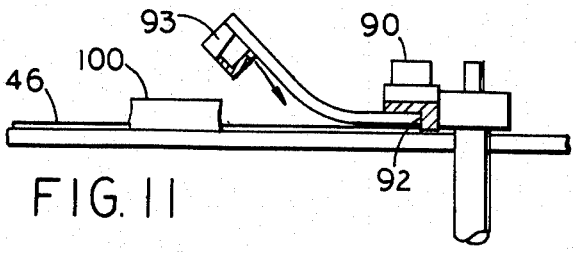
FIG. 11
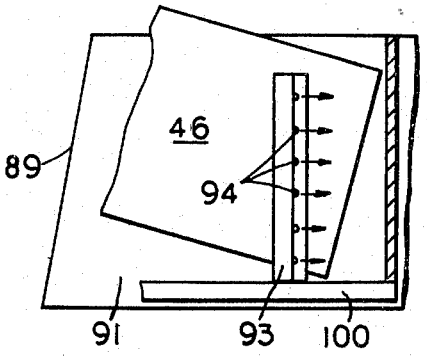
FIG. 15
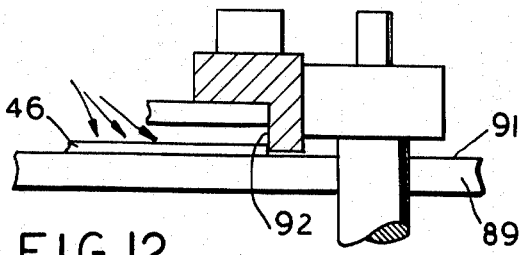
FIG. 12
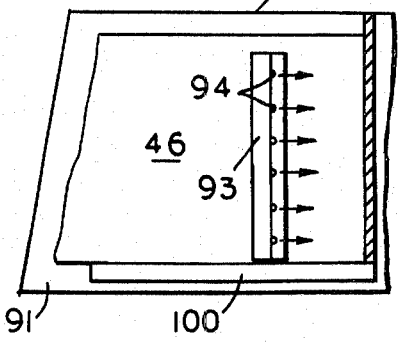

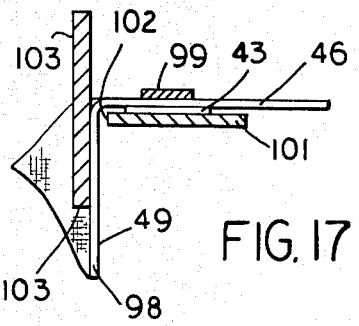
FIG. 17
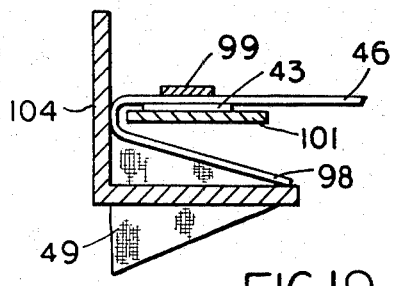
FIG. 19
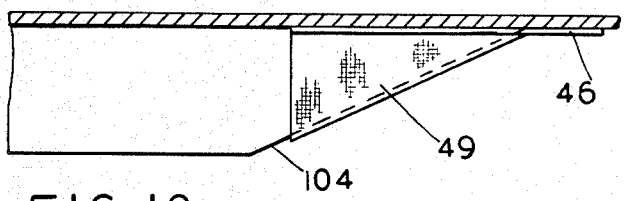
FIG. 18
FIG. 21
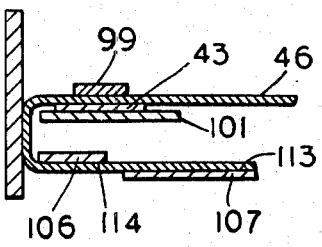
FIG. 20
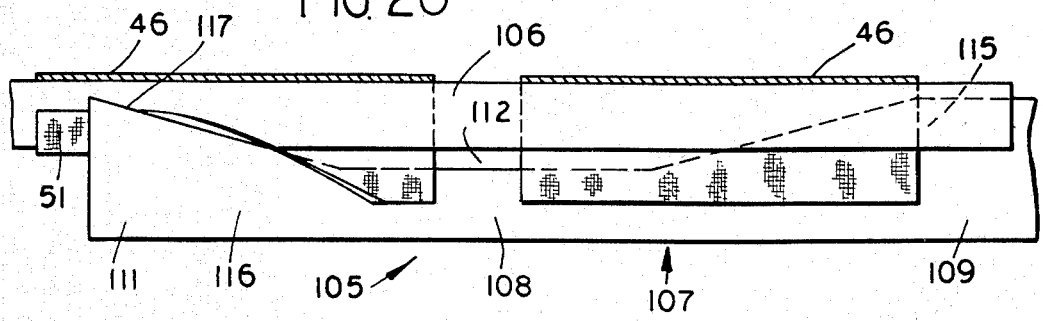
FIG. 22
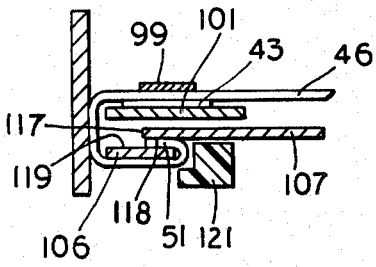
FIG. 23
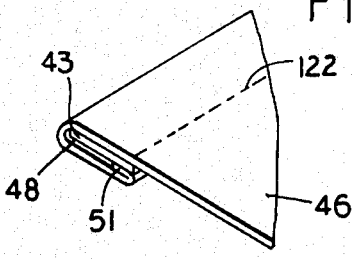

APPARATUS FOR MANUFACTURING AND STACKING HEMMED FABRIC PIECES

This is a division of application Ser. No. 344,227, filed Mar. 23, 1973, now U.S. Pat. No. 3,898,941.

BACKGROUND OF INVENTION

According to the prior art, commercial sale manufacture and stacking of hemmed fabric pieces (such as pockets) was for the most part a manual operation performed by workers using substantially conventional sewing machines. Quality of the hemmed fabric pieces varied among individual workers and as an essentially hand operation there were inherent limitations in quality. The work was monotonous so there was danger of injury to workers. Labor costs in this operation were high and substantial waste of material was experienced. Further, stacking of the hemmed fabric pieces (lined or unlined) presented difficulty because the hemmed end being thicker than the other end caused stacks to build up on the hemmed end tending the stacks to fall over onto the unhemmed ends opposite to the hemmed ends.

With growing popularity of stretch fabrics, knitted fabrics and bias cut woven fabrics, hemming of pockets was usually impractical and at times impossible using apparati of the prior art.

The prior art with regard to dispensers, for cutting and feeding automatically pieces of a liner tape in turn along a path, has been directed to other services. However U.S. Pat. No. 3,479,911 taught an apparatus for clamping a web of flexible material, cutting the web into increments of length and advancing the web to a work station. U.S. Pat. No. 3,465,624 disclosed a control system for a film cutter. U.S. Pat. No. 3,400,622 showed an apparatus for cutting a strip material into pieces of incremental length and included moving, feeding and shearing functions. In U.S. Pat. No. 2,722,276 strip stock was fed from a roller by means of a self-releasing self-cocking trip-type clutch. U.S. Pat. Nos. 2,062,643 and 2,783,042 used one-way clutches on a friction roller for feeding paper from a stack to a machine. U.S. Pat. Nos. 1,127,991 and 1,526,670 related to feeding of paper to printing presses.

The prior art on positioners, for accepting limp fabric pieces inserted manually and for positioning each of the fabric pieces automatically, was relatively remote from the teaching of this application. U.S. Pat. No. 3,360,262 taught an apparatus for transporting and aligning limp pieces of material by means of pneumatics. U.S. Pat. No. 3,544,098 employed an edge as a stop means for registering fabric work pieces.

The prior art folders, for forming a hem, are represented by U.S. Pat. Nos. 1,864,503; 3,463,482; 3,481,292 and 3,534,954.

The prior art on stackers, for stacking hemmed fabric pieces into a cartridge vertically and for revolving the cartridge as successive of the hemmed fabric pieces are inserted therein, includes references from various other fields. One reference relating to pockets is U.S. Pat. No. 3,400,841. U.S. Pat. No. 3,115,090 is directed to a packaging machine. Matches are stacked in U.S. Pat. No. 1,880,077 and ingots are stacked in U.S. Pat. No. 2,970,708. U.S. Pat. No. 3,456,423 is directed to stacking of filled envelopes and U.S. Pat. Nos. 3,450,275 and 3,599,807 relate to stacking of newspapers.

STATEMENT OF INVENTION

The present invention answers the problems of the prior art in a particularly useful, novel, unobvious and facile way. An apparatus has been developed for manufacturing and stacking hemmed fabric pieces such as pockets (lined or unlined). In the case of lined hemmed fabric pieces, pieces of liner tape are fed in lengths in turn along a path. The limp fabric pieces, inserted manually by an operator, are positioned automatically each on one of the liner pieces. A hem is formed from a margin of each of the fabric pieces around its related liner piece and a terminal margin flap is tucked under itself. The hem is sewn automatically along the terminal margin flap. For stacking, the lined hemmed fabric pieces are inserted into a cartridge upwardly and the cartridge is revolved about a vertical axis as successive of the lined hemmed fabric pieces are inserted therein so that uneven height caused by the lined hems is distributed peripherally about the stack. In the case of unlined faric pieces, the apparatus functions substantially the same in positioning the limp fabric pieces, hemming and stacking.

Accordingly one object of this invention is to provide a simple, reliable and automatic apparatus for manufacturing lined (or unlined) hemmed fabric pieces.

Another object is to improve quality of the hemmed fabric pieces.

A still further object is to improve safety in manufacture of hemmed fabric pieces.

A still further object is to reduce costs in manufacture of the hemmed fabric pieces.

A still further object is to reduce waste of materials in manufacture of the hemmed fabric pieces.

A still further object is to permit stacking of the hemmed fabric pieces in stacks with substantially straight sides.

A still further object is to provide apparatus for hemming stretch fabrics, knitted fabrics and bias cut woven fabrics.

BRIEF DESCRIPTION OF DRAWINGS

The foregoing and other features and advantages will be understood more fully from the following description of a detailed embodiment of the apparatus for manufacturing and stacking hemmed fabric pieces according to this invention viewed in conjunction with the accompanying drawings wherein:

FIG. 1 is a somewhat idealized elevation view showing general arrangement of the apparatus.

FIG. 1A is an elevation view in section showing a lined hemmed fabric piece.

FIG. 2 is a plan view of a liner tape dispenser.

FIG. 3 is an elevation view of the liner tape dispenser.

FIG. 4 is an elevation view in section taken along line 4—4 of FIG. 3 and showing a finger.

FIG. 5 is an elevation view in section taken along line 5—5 of FIG. 2 and showing a cutter.

FIG. 6 is an elevation view in section taken along line 6—6 of FIG. 2 and showing a staging member in relation to a positioner endless belt.

FIG. 7 is an elevation view transverse of a path for the pieces and showing a shutter over the positioner endless belt and a staging member above the positioner endless belt.

FIG. 8 is an elevation view similar to FIG. 7 with both the shutter and the staging member retracted.

FIG. 9 is a plan view of a positioner.

FIG. 10 is a detail elevation view partly broken and showing the shutter with a curled fabric piece thereon.

FIG. 11 is similar to FIG. 10 with the curled fabric piece straightened and brought into contact with a guide abutment.

FIG. 12 is a detail elevation view partly broken showing the fabric piece aligned against the guide abutment.

FIG. 13 is a detail elevation view of an uncurler which directs flow over the fabric piece toward the guide abutment.

FIG. 14 is a detail plan view showing a fabric piece being straightened against the guide abutment by action of the uncurler.

FIG. 15 is a view similar to FIG. 14 with the fabric piece straightened against the guide abutment.

FIG. 17 is a detail elevation view in section taken along line 17—17 of FIG. 16 and showing a fabric piece being bent by a stationary folder member.

FIG. 18 is a partial plan view taken along line 18—18 of FIG. 16.

FIG. 19 is a detail elevation view in section taken along line 19—19 of FIG. 16 and showing a second stationary folder member folding the fabric piece around a folder plate.

FIG. 20 is a partial plan view taken along line 20—20 of FIG. 16 and showing a die of the folder for tucking under a terminal margin flap.

FIG. 21 is an elevation view in section taken along line 21—21 of FIG. 16 and showing action of the die of the folder.

FIG. 22 is an elevation view in section taken along line 22—22 of FIG. 16 and showing further action of the die of the folder.

FIG. 23 is a perspective view showing a lined hemmed fabric after the sewing operation has been completed along the terminal margin flap.

Detailed Description of Preferred Embodiment

Figure 30:
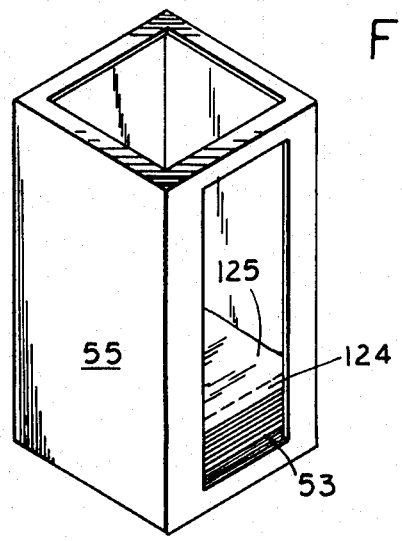
FIG. 30 is a perspective view showing the cartridge partially filled.

This apparatus for manufacturing and stacking lined hemmed fabric pieces can be seen in FIG. 1 to comprise a dispenser (generally designated 41) for cutting and feeding automatically liner tape 42 of constant width in liner pieces 43 each of a same predetermined length in their lengthwise directions in turn along a path 44. A positioner (generally designated 45) is situated along the path 44 for accepting limp fabric pieces 46 inserted in turn manually and the positioner each of the fabric pieces 46 automatically onto one of the liner pieces 43. From the positioner 45 the fabric pieces 46, each together with an associated liner piece 43, are delivered to a folder (generally designated 47) for forming a lined hem 48 out of a margin 49 of each of the fabric pieces 46 folded around its associated liner piece 43 and having a terminal margin flap 51 tucked under itself ready for sewing. A sewing machine (generally designated 52) is arranged for sewing the lined hem 48 along the terminal margin flap 51. Lined hemmed fabric pieces 53 are delivered thereafter to a stacker (generally designated 54) in which the lined hemmed fabric pieces 53 are loaded vertically upward into a cartridge 55 (see FIG. 30) which is arranged to revolve in increments about a vertical axis 56 so that, as successive of the lined hemmed fabric pieces 53 are inserted therein, uneven height caused by the lined hems 48 is distributed peripherally about the stack.

The dispenser 41 cuts and feeds automatically the liner tape 42 of constant width as the liner pieces 43 each of a like predetermined length lengthwise along the path 44. Tape supply spool 57 is mounted rotatably about a horizontal spool axis 58. A continuous feed of the liner tape 42 is wrapped on the spool 57 and the spool 57 is organized to rotate freely about the axis 58. The liner tape advances one of said predetermined lengths at a time forwardly along the path 44 to a cuttable position wherein the front end of a liner tape length is at 59 and its rear end is at 61. A feed platform 62 is organized along the path 44 to support the continuous liner tape 42.

Advancement is achieved by a pusher member which is shown as a roller 63 having a knurled surface for engaging the continuous liner tape 42. A first motion means is shown as a first piston 64 connected to the roller 63 and a first air cylinder 65 to provide two-way rectilinear movement of the roller 63 forwardly and rearwardly along the path 44. The first motion means is organized to move the roller 63 in response to a first signal from a first sensor 66 which indicates presence of the liner tape 42 in the cuttable position. The first motion means moves the roller 63 from an initial forward position against abutment 82 rearwardly to a rearward position shown in FIGS. 2 and 3. Slip means are provided in the form of a one-way clutch 67 in roller 63 whereby on moving rearwardly roller 63 rolls over the liner tape 42 but on moving forwardly roller 63 is prevented from rotating so that it engages the liner tape 42 to move it forwardly. When roller 63 reaches its rearward position shown in FIGS. 2 and 3 adjustment screw 68 connected thereto triggers switch 60 for automatic return of roller 63 to its forward position. Roller 63 is mounted on a shaft depending between yoke members 69 which engage the first piston 64 in the first air cylinder 65. The length of travel of the roller 63 can be varied by adjustment of the length of screw 68 to set the constant length of liner tape fed to the cuttable position on each movement of the roller 63 forwardly on the path 44.

A finger 71 retains the liner tape 42 on rearward movement of the roller 63. A second motion means, shown as a second piston 72 housed in a second air cylinder 73, is connected to the finger 71 for providing two-way movement vertically between an initial retracted position (not shown) wherein the finger 71 is above the feed platform 62 and a holding position shown in FIG. 4 wherein the finger 71 holds the liner tape 42 against the feed platform 62. A positioner endless belt 74 is arranged forward of the finger 71 along the path 44 and is organized to advance the liner tape 42 forwardly. A hold down element 75 is mounted to press the liner piece 43 onto the positioner endless belt 74. A cutter comprises knife 76 and is positioned along the path between the finger 71 and the hold down element 75. A third motion means, shown as a third piston 77 mounted in a third air cylinder 78, is connected to the knife 76 as shown in FIG. 5 via a lever 79 mounted for rotation on a fulcrum member 81, so that the knife 76 is movable between an initial retracted position wherein it is retracted and a cutting position shown in FIG. 5 wherein the knife cuts from the liner tape 42 one of the liner pieces 43.

The dispenser 41 operates from a starting arrangement with the first piston 64 extended to abutment 82, the second piston 72 in its retracted position and the third piston 77 in its retracted position. In this arrangement a length of the liner tape 42 is already in the cuttable position from 59 to 61. To start the operation the first signal is transmitted as has been mentioned from first sensor 66 via a dispenser circuit to the first air cylinder 65 advancing the first piston 64 to move the roller 63 rearwardly. Simultaneously a second signal is transmitted by the dispenser circuit to move the finger 71 to its holding position. The dispenser circuit is arranged then to transmit a third signal to the third air cylinder 78 to move the knife 76 to its cutting position. The dispenser circuit further includes second and third reset means to signal thereafter return of the finger 71 and the knife 76 respectively to their initial positions.

The positioner 45 located along the path 44 accepts the fabric pieces 46 inserted manually thereon and positions each of the fabric pieces 46 automatically onto one of the liner pieces 43. The liner pieces 43 exit the dispenser by means of the positioner endless belt 74. A staging member 83 has a horizontal upper surface with a groove 84 adapted to receive in turn leading edges of the liner pieces 43 to position each of the liner pieces in turn for reception of one of the fabric pieces 46. Fourth motion means, shown as a fourth piston 85 mounted in fourth air cylinder 86, is connected to the staging member 83 for providing two-way movement vertically between an initial receiving position wherein the staging member 83 projects above the positioner endless belt 74 as shown in FIG. 7 and a withdrawn position wherein the staging member 83 is below the belt as shown in FIG. 8. Additional positioner endless belts 87 are provided and the staging member 83 has lands 88 which project vertically between adjacent of the positioner endless belts 74, 87.

A shutter 89 is positioned above the positioner endless belts 74, 87 and has an upper surface 91 on which the limp fabric pieces 46 are placed manually one by one. Guide abutment 92 aligned with the path 44 and the fabric pieces 46 are positionable in turn thereagainst for alignment along the path 44. An uncurler, comprising a manifold 93 connected to a suitable supply of a gas (preferably air and not shown), advances the fabric pieces 46 toward the guide abutment 92 to eliminate curls in the limp fabric pieces 46 and to maintain alignment of the fabric pieces 46 with the guide abutment 92. The apertures 94 are shown in FIG. 13 and operation of the uncurler is shown in FIGS. 10–12 and 14–15. Fifth motion means, shown as a fifth piston 95 mounted in a fifth air cylinder 96, is coupled by means of a shutter crank 97 to the shutter 89 and provides the shutter 89 with two-way movement horizontally and transversely of the path 44 between an initial position over the positioner endless belts 74, 87 as shown in FIG. 7 and a withdrawn position as shown in FIG. 8 whereby on movement of the shutter 89 to the withdrawn position the fabric piece 46 on the shutter 89 drops onto its associated liner tape piece 43 on the staging member 83. The fourth motion means which are the fourth piston 85 and the fourth air cylinder 86 are then operated on movement of the shutter to its withdrawn position to move the staging member 83 to its withdrawn position so as to seat the fabric pieces 46 in turn each onto one of the liner pieces 43 on the positioner endless belt 74.

Operation of the positioner 45 is controlled by a positioner circuit which includes a fifth sensor means 90 to sense one of the fabric pieces 46 in position along the guide abutment 92 for transmitting the fifth signal to the fifth air cylinder 96 to actuate movement of the shutter 89 to its retracted position shown in FIG. 8 whereby one of the fabric pieces 46 drops onto the staging member 83. The positioner circuit also includes a fourth switch 100 to activate on movement of the shutter 89 to its retracted position to transmit the fourth signal to the fourth air cylinder to actuate movement of the staging member 83 to its retracted position.

The positioner is initiated by action of the worker. The positioner operates with the worker placing one of the fabric pieces 46 on the shutter 89 and pushing it up to and against the guide abutment 92. To uncurl the margin of the fabric piece 46, gas flow is provided through the apertures 94 in the uncurler manifold 93. When the fabric piece 46 approaches the guide abutment 92 but prior to contact therewith, the fifth sensor means 90 transmits a fifth signal to activate the fifth cylinder 96 extending the fifth piston 95 moving the shutter 89 to its withdrawn position as shown in FIG. 8. As the shutter 89 is drawn out of the way, the fabric piece 46 is positioned accurately against abutment 92, is indexed along the path by a fence 100 and falls onto the staging member 83 on top of one of the liner tape pieces 43 which is already there. When the shutter 89 is retracted fully the fourth switch 100 transmits a fourth signal to fourth air cylinder 86 to retract the staging member 83 below the level of the constantly running positioner endless belts 74, 87 permitting the positioner endless belts 74, 87 to carry the fabric piece 46 and the positioner endless belt 74 to carry the liner piece 43 together in desired relationship to each other for delivery to the folder 47.

The folder 47 forms the lined hem 48 (seen in FIG. 23) out of the margin 49 of the fabric piece 46 folded around the associated liner piece 43 and having a terminal margin flap 51 tucked under itself. The fabric piece 46 and the liner piece 43 are fed together along a straight path with the fabric piece 46 atop the liner piece 43. Margin 49 projects beyond the liner piece 43 transversely of the path 44. The margin 49 has a leading margin end 98 which viewed from the front is here considered to have an initial zero degree rotational orientation (in a plane normal to the path 44. A folder endless belt 99 is organized to engage the fabric piece 46 and with it an associated liner piece 43 for advancing them together in contact with a folder plate 101 along the path 44. The folder plate 101 has folder plate edge 102 aligned along the path 44. When the leading margin end 98 of the fabric piece 46 comes into contact with a first stationary folder member 103, the leading margin end 98 is folded laterally downward past the folder plate edge 102 as shown in FIG. 17. The first stationary folder member 103 rotates the margin 49 about 90° (in a plane normal to the path 44) from the initial orientation of the leading margin end. A second stationary folder member 104 engages the leading margin end 98 and folds the margin 49 under the folder plate 101 approximately an additional 90° rotation (in a plane normal to the path 44) from the initial orientation of the leading margin end as shown in FIG. 19.

Ultimately the margin 49 terminates transversely in margin flap 51. To this end, a die 105 is arranged along the path 44 forward of the stationary folder members 103, 104 and is organized for folding the advancing margin flap 51 toward the folder plate 101 and backward to the initial orientation of the leading margin end. The die 105 comprises mainly a first die plate 106 and a second die plate 107 both running substantially along the path 44. The first die plate 106 is straight and continuous. The second die plate 107 is on two elevations and it intersects the plane of the first die plate 106 at designation 108 as well as overlapping the first die plate 106, below at 109 and above at 111 (see FIG. 20) and by virtue of its angular design the second die plate 107 leaves an open space 112 between the two die plates 106, 107 at their middle portion. The piece 46 proceeds along the folder plate 101 in a substantially C-shaped configuration. When the margin 49 reaches the die 105, it is riding between a top surface 113 of the second die plate 107 and a bottom surface 114 of the first die plate 106 (see FIG. 21). The angular portion 115 prevents the margin 49 from falling away. As the margin 49 proceeds it comes to another angular portion 116 and edge 117 forcing the edge of margin 49 around the first die plate 106 to form margin flap 51. The margin flap 51 now rides between a lower surface 118 of the second die plate 107 and a top surface 119 of the first die plate 106 causing the piece 46 to assume a substantially G-shaped configuration (see FIG. 22). A shaped bar 121 is also included to help maintain the G-shaped configuration until sewing of the line hem 48 takes place along line 12 as shown in FIG. 23.

Figure 16:
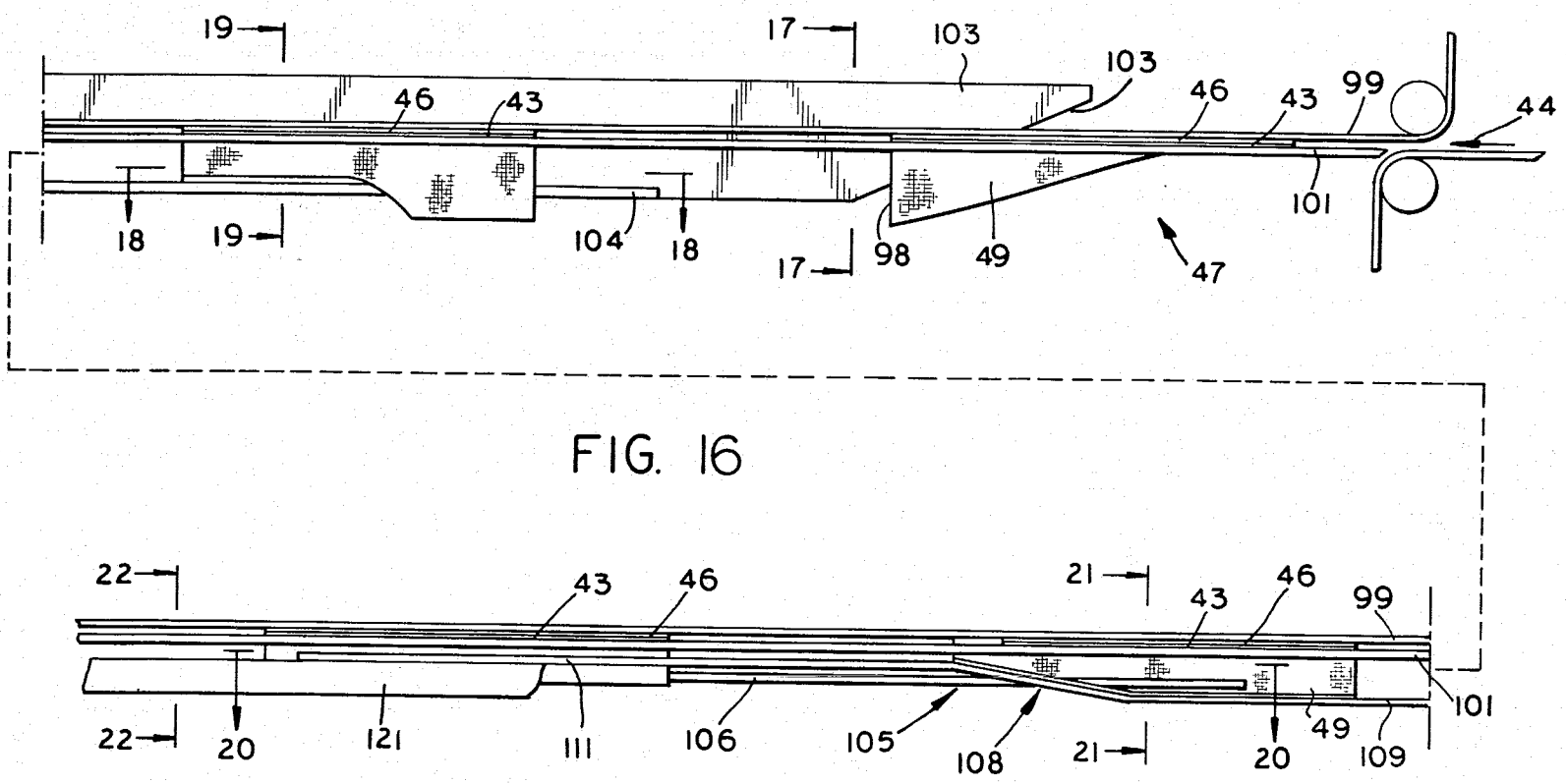
FIG. 16 is a somewhat idealized elevation view partly broken of a folder viewed along the path.
Figure 24:
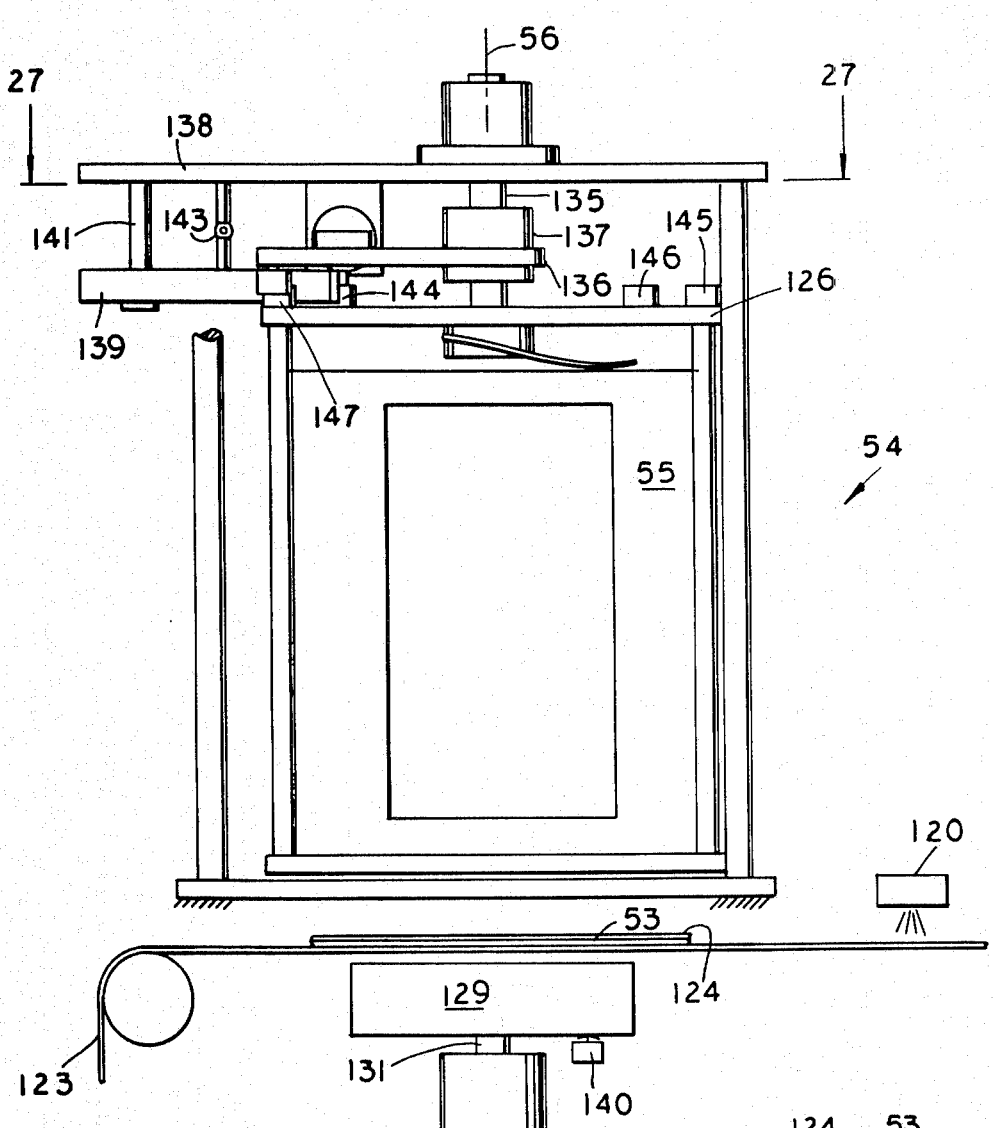
FIG. 24 is an elevation view of a stacker seen transversely of the path.
Figure 25:
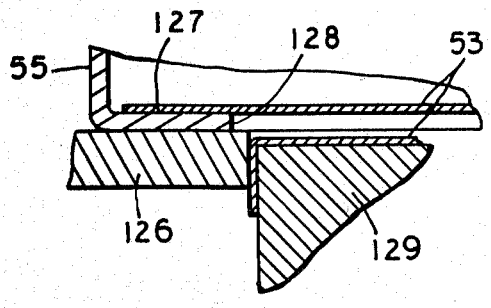
FIG. 25 is a detail elevation view in section and showing a lined hemmed fabric piece being bent as it enters a stacker cartridge.
Figure 26:
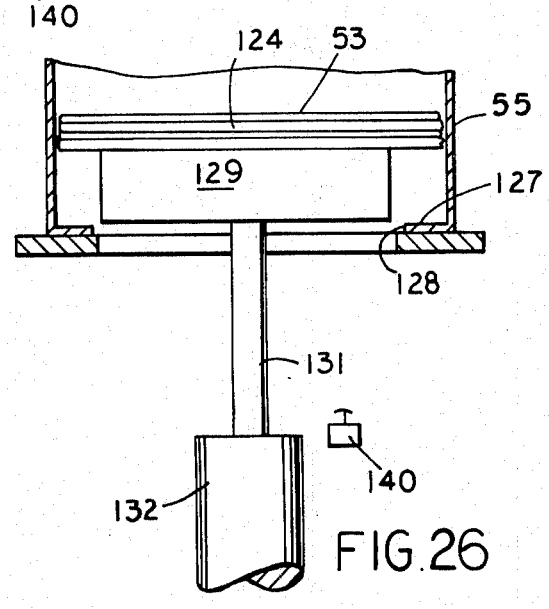
FIG. 26 is a detail elevation view in section and showing a plurality of the lined hemmed fabric pieces in relaxed conditions inside the cartridge.

As the lined hemmed fabric piece leaves the sewing machine 52 it is delivered by means of a stacker endless belt 123 to the stacker 54. Each of the lined hemmed fabric pieces 53 has an enlarged height 124 on one of its ends and it is a principal object of the stacker 54 to distribute the enlarged heights peripehrally about a stack 125 so that the stack 125 will not be inclined to fall over. The stacker 54 includes revolvable frame 126 mounted for revolving about a vertical axis 56 and adapted to support a cartridge 55. The cartridge 55 has a cartridge bottom 127 provided with a cartridge bottom opening 128. Stacker endless belt 123 delivers the lined hemmed fabric pieces 53 beneath the revolvable frame 126. Elevator 129 has lands (not shown) which project past the stacker endless belt 123 whereby the elevator 129 penetrates into the cartridge 55 via the cartridge bottom opening 128. Sixth motion means, shown as a sixth piston 131 mounted in a sixth air cylinder 132, is connected to the elevator 129 for providing up and down movement between an initial down position shown in FIG. 24 wherein the elevator 129 is below the stacker endless belt 123 and an up position shown in FIG. 26 wherein the elevator lifts one of the lined hemmed fabric pieces 53 into the cartridge 55 via the cartridge bottom opening 128. Elevator 129 has a horizontal profile smaller than that of the lined hemmed fabric pieces 53. Also the cartridge bottom opening 128 is smaller than the horizontal profile of the lined hemmed fabric pieces 53 so that each of the lined hemmed fabric pieces 53 is deformed as it enters the cartridge 55 and relaxes therein whereby on return of the elevator 129 to its down position the lined hemmed fabric piece sits on the cartridge bottom 127 about the cartridge bottom opening 128.

The revolvable frame 126 is revolved 90° between succeeding insertions of the lined hemmed fabric pieces 53 into the cartridge 55. A seventh motion means, shown as a seventh piston 133 mounted in a seventh air cylinder 134, revolves the revolvable frame 126 about the vertical axis 56. A stacker circuit commences operation with the elevator 129 in its down position shown in FIG. 24 and includes a sixth sensor to detect approach of one of the lined hemmed fabric pieces 53 on the stacker endless belt 123 to beneath the revolvable frame 126. The stacker circuit transmits a sixth signal on actuation of a sixth sensor 120 to move the elevator to its up position shown in FIG. 26. An air pulse signal is tied to sixth air cylinder 132 to enable it to complete a cycle returning the elevator 129 automatically from its up position to its down position. A seventh switch 140 is provided in the stacker circuit to detect return of the elevator 129 toward its down position. The stacker circuit also has means for transmitting a seventh signal on movement of the seventh switch to revolve the revolvable frame 126.

Figure 27:
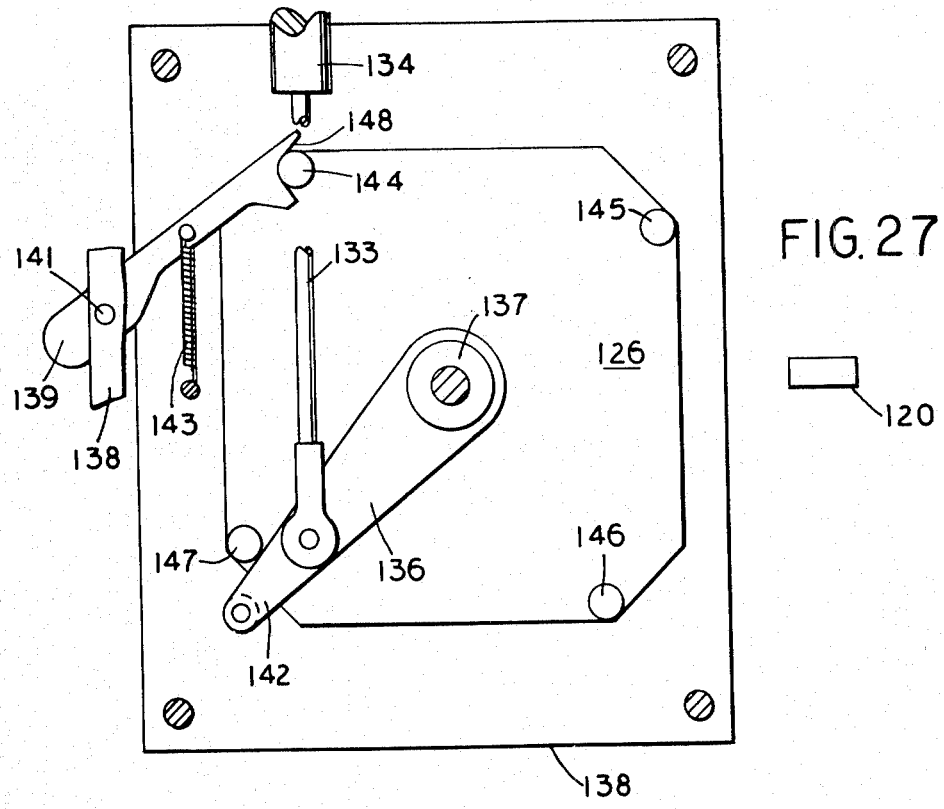
FIG. 27 is a plan view taken along line 27—27 of FIG. 24 and showing a rotatable frame supporting the cartridge with the cartridge aligned to receive one of the lined hemmed fabric pieces therein.
Figure 28:
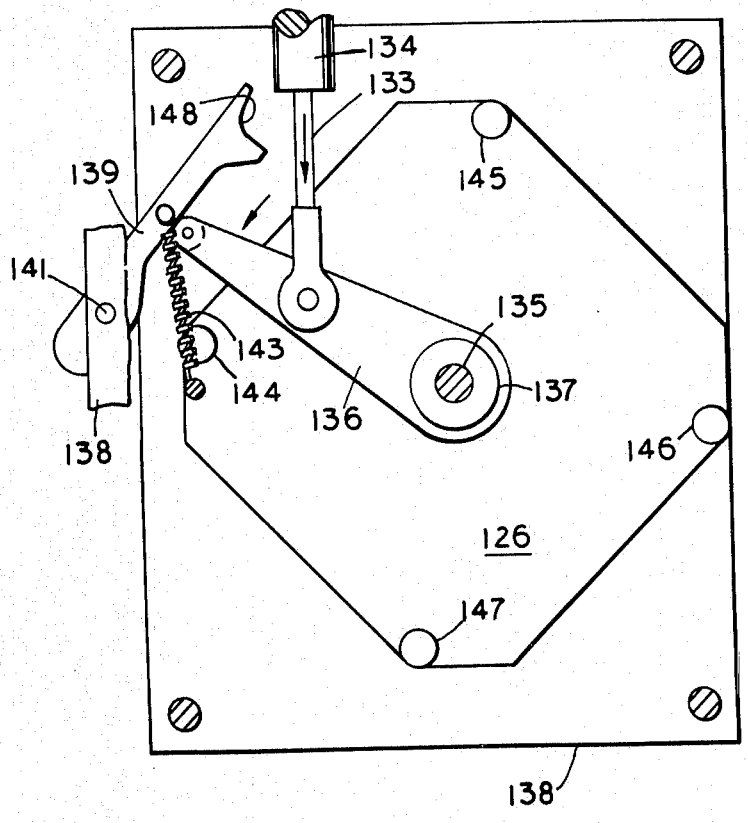
FIG. 28 is a view similar to FIG. 27 and showing partial rotation of the movable frame.
Figure 29:
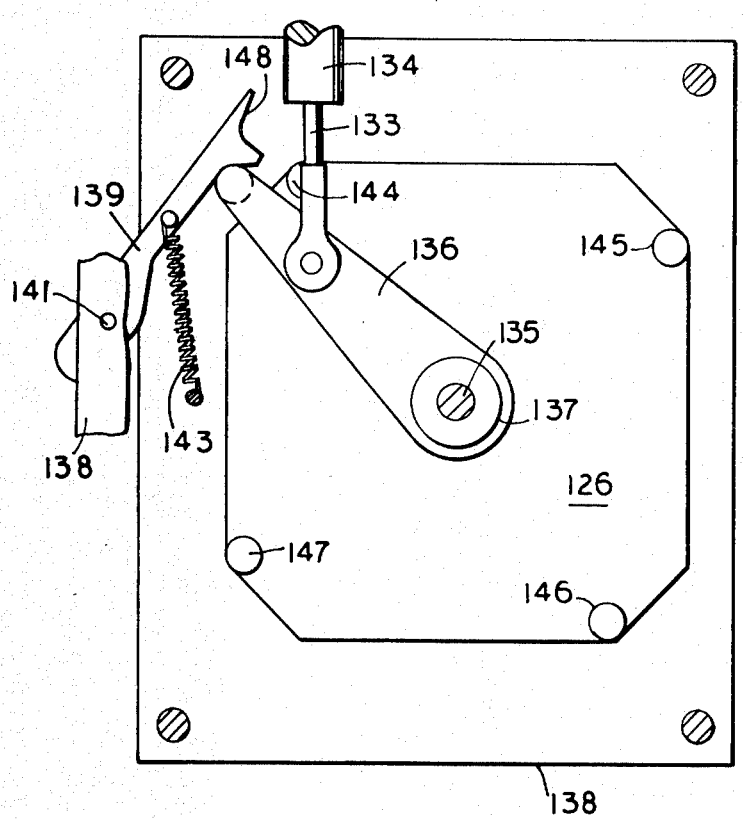
FIG. 29 is another view similar to FIG. 27 and showing full retraction of a piston to turn the frame.

The revolvable frame 126 depending from a vertical shaft 135 is arranged along the vertical axis 56. A seventh piston 133 is connected to a vertical shaft 135 by means of a revolver crank 136 and a one-way clutch 137 and a stationary frame 138 has a lever arm 139 mounted pivotally thereon about a post 141. The revolver crank 136 has a horizontal extension 142 formed thereon. A spring 143 normally urges the lever arm 139 about the post 141. The revolvable frame 126 has a series of cam followers 144, 145, 146 and 147 mounted thereon. The lever arm 139 is provided with a seat 148 adapted to engage the cam followers one at a time whereby the revolvable frame 126 is oriented when one of the cam followers is positioned in the seat 148 to receive one of the lined hemmed fabric pieces 53. The seventh piston 133 is movable in response to the seventh signal to cause the horizontal extension to disengage one of the cam followers 144 from the seat 148. When the seventh piston 133 moves, the horizontal extension 142 engages the lever arm 139 pivoting the lever arm 139 about the post 141, disengaging the seat 148 from the cam follower 144. The piston 133 is retracted fully (see FIG. 29) and the piston 133 is caused to reverse direction and proceed to its extended position. The one-way clutch 137 engages the shaft 135 for counter clockwise rotation of the shaft 135 when the piston 133 extends the revolver crank 136 about the vertical axis 56. The horizontal extension 142 maintains the seat 148 in a disengaged position and the clutch 137 causes the revolvable frame 126 to rotate counter clockwise about the vertical axis 56. As the piston 133 approaches its fully extended position, the horizontal extension 142 in its sliding engagement with the lever arm 139 and urging of the spring 143 causes the return of the lever arm 139 to its initial position (see FIG. 27) thereby causing the cam follower 145 to come to rest in contact with the seat 148 locking the revolvable frame 126 in its next position.

It will be understood by those familiar with manufacturing and stacking of lined hemmed fabric pieces that various deviations can be made from the foregoing preferred embodiment without departing from the theme of invention set forth in the claims.

We claim:

1. Apparatus for folding sequentially one side margin of a plurality of fabric pieces conveyed along a path defined by a continuously moving conveyor 99 engaging the upper surface of said fabric pieces to form a hem in each of said pieces, each said piece being positioned with said margin projecting to one side of said path; characterized by a. a horizontal folder plate 101 for engaging the bottom surfaces of said sequentially fed fabric pieces, said folder plate having a folder plate edge 102 defining the first fold position of said hem;

b. a first vertical folder member 103 disposed spaced from and adjacent said folder plate edge, the edge 103(a) of said first vertical folder member for engaging the advancing leading edge of each side margin of said fabric pieces to form between said folder plate edge and said first vertical folder member a margin flap 49;

c. a second folder member 104 in said path downstream of said vertical folder member, said second folder member having a vertical portion 104(b) and a horizontal portion 104(a) for engaging the leading edge of said advancing margin flap 49 for folding said margin flap 49 toward the bottom surface of said folder plate 101;

d. a first die plate 106 for engaging the upper surface of said folded advancing margin flap 49;

e. a second die plate 107 spaced horizontally from said first die plate in said path for engaging the lower surface of said advancing margin flap 49, said first 106 and second 107 die plates being disposed downstream of said second folder member in said path;

f. said first 106 and second 107 die plates being spaced vertically from each other to accommodate the thickness of said folded margin flap 49 when first engaging said margin flap;

g. the lower engaging surface 114 of said first die plate 106 extending continuously in a single horizontal plane;

h. the upper engaging surfaces 113 of said second die plate 107 gradually inclined 108 along said path of travel from a first horizontal plane 109 below the plane of the engaging surface 114 of said first die plate 106 to a plane 111 above the engaging surface 114 of said first die plate 106 for folding the edge of said margin flap 49 inwardly of itself to form a second edge hem 51; and i. a shaped bar 121 for holding said folded hems in position under each fabric piece prior to sewing.

2. The apparatus of claim 1, further characterized by a. said sequentially folded fabric pieces 46 including an elongated tape piece 43 extending longitudinally of said path along said first fold position of said hem; and b. each said liner tape piece 43 lying on said folder plate under its respective fabric piece 46.

* * * * *